US009884702B1

(12) United States Patent
Burns

(10) Patent No.: US 9,884,702 B1
(45) Date of Patent: Feb. 6, 2018

(54) SKI EQUIPMENT CASE

(71) Applicant: Rosemarie Burns, Tuckahoe, NY (US)

(72) Inventor: Rosemarie Burns, Tuckahoe, NY (US)

( * ) Notice: Subject to any disclaimer, the term of this patent is extended or adjusted under 35 U.S.C. 154(b) by 0 days.

(21) Appl. No.: 15/186,750

(22) Filed: Jun. 20, 2016

(51) Int. Cl.
*B65D 21/08* (2006.01)
*A63C 11/00* (2006.01)
*B65D 43/16* (2006.01)
*B65D 25/10* (2006.01)

(52) U.S. Cl.
CPC ..... *B65D 21/086* (2013.01); *A63C 11/00* (2013.01); *B65D 25/10* (2013.01); *B65D 43/16* (2013.01)

(58) Field of Classification Search
CPC ..... A63C 11/025–11/028; B60R 9/055; B60R 9/12; B65D 5/0005; B65D 5/324; B65D 21/086; B65D 25/103; B65D 85/20
USPC ..... 206/315.1, 315.11; 220/4.22, 8; D3/261; 224/917, 917.5; 190/22, 104–105, 17
See application file for complete search history.

(56) References Cited

U.S. PATENT DOCUMENTS 2,475,961 A * 7/1949 Hilbert ..... A45C 7/0031 220/8
2,699,848 A * 1/1955 Kaplan ..... A45C 7/005 190/105
3,767,036 A 10/1973 McLeod
3,837,548 A * 9/1974 Nerger ..... A63C 11/027 206/315.1
4,126,254 A 11/1978 Sahakian
4,161,268 A * 7/1979 Heil ..... A63C 11/028 206/315.1
4,238,063 A 12/1980 O'Dair
4,867,307 A 9/1989 Bovee
5,160,075 A 11/1992 Moscovitch
D332,695 S 1/1993 Moscovitch
5,192,019 A * 3/1993 Meehan ..... B65D 5/0005 220/8
5,799,848 A 9/1998 Wills
6,311,883 B1 * 11/2001 Greenberg ..... A63C 11/025 206/315.1
6,450,333 B1 * 9/2002 McClenahan ..... A01K 97/08 206/315.11
2007/0125671 A1 * 6/2007 Stephens ..... B65D 5/0005 206/315.1

FOREIGN PATENT DOCUMENTS

WO WO9114485 10/1991
WO WO9200784 1/1992

* cited by examiner

*Primary Examiner* — Chun Cheung
*Assistant Examiner* — Brijesh V. Patel
(74) *Attorney, Agent, or Firm* — Goldstein Law Offices, P.C.

(57) ABSTRACT

A ski equipment case suitable for carrying lengthy ski equipment such as snow skis, a snowboard and ski poles. The case comprises a pair of an inner box and an outer box, each having an upper half and lower half that are connected by a hinge so that the two halves can move relative to each other between an open and closed position of the case. The inner box slides within the outer box between a compact position wherein the inner box is completely within the outer box and various elongated positions to allow for various sized ski equipment. The case also includes locking means to fix the inner box and outer box at various positions.

14 Claims, 6 Drawing Sheets

SKI EQUIPMENT CASE

TECHNICAL FIELD

The present disclosure relates generally to a case for carrying ski equipment. More particularly, the present disclosure relates to a collapsible case which is adjustable for carrying ski equipment, including skis, snow boards, and ski poles of various sizes, and allowing easy packing and unpacking thereof.

BACKGROUND

While the first time or occasional skier might rent skis when needed, those who have caught the skiing bug prefer to own their own skis. For the avid skier, however, the reality quickly sets in that owning your own skis means transporting them to whatever ski location you visit.

There are various snow ski cases/carriers available in the market. Most of the cases available in the market are bulky and inflexible to adjustments for various sizes of the skis available. As a result, when a skier changes his ski set when upgrading to a higher level, he is compelled to change his case also and spend more money.

A solution to this problem is a typical 'big' case, which is meant for skis measuring up to about 215 cm. An average skier generally chooses a ski with a length, which is approximately the distance between his head and foot, and is increased and decreased slightly according to experience level. Therefore, the length of the ski will rarely exceed 215 cm. From a desire to provide standardized cases, which is sized for all skis, many case manufacturers create a one-size-fits all case that is manufactured to accommodate skis up to the maximum length. As a result, the skier may end up carrying a case which has extra space that may never be needed and thus must carry a case having unneeded length and unnecessary weight. This becomes quite cumbersome for the skier while travelling. Considering that avid skiers often do a great deal of travelling, carrying a case/bag, which is larger than required does not make much sense.

Another issue with the ski cases in the market is that even after taking their skis out of the case, the skier has to make space for the bulky big case which still requires the same amount of space whether holding the skis or not.

Another problem with the cases available in the market is that they open at the end and require skis to be inserted and taken out of the case axially. With the significant length of the skis, it is difficult to maneuver the skis out of the case and into it. Considering that the skis may be six feet long, removing the skis from the end of the case may require more than twelve feet of space! Thus when travelling in tight quarters, it might not even be possible to remove and repack one's skis without needing to go outside.

To overcome the problem associated with the bulkiness of the case, manufacturers have tried to make cases out of fabric and other textile materials. But these tend to wear out quickly and are prone to entangle while travelling especially on baggage conveyances. Further, the fabric case, though light and flexible, often provides insufficient protection to the skis. Therefore, the skiers generally prefer a hard ski case, and must deal with all of the drawbacks mentioned above.

Other cases available in the market have too many parts, which are loose and there is a risk of losing them. Further, many require that the skis and poles be arranged in a bundle before they can be inserted in the case.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to carry ski equipment such as snow skis, snow boards, ski poles and the like of varying sizes in a case which is collapsible and sturdy. Accordingly, the present disclosure provides a case suitable for carrying lengthy skiing equipment comprising an inner box and an outer box which are each made in two halves, an upper and a lower half, and are open at one of the ends. The two halves of each box are hinged together on one of the longitudinal edges connecting the upper halves to the lower halves of each box to enable movement between an open position and a closed position of the case. The case includes means for slidably engaging the boxes such that the inner box slides and telescopes into and out of the outer box between an initial compact position where the inner box is nearly completely enclosed within the outer box and other extended, ski-storing positions where the inner box protrudes beyond the open end of the outer box. The case also includes means for locking the inner box to the outer box at the compact position as well as at the various ski storing positions.

It is yet another aspect of an example embodiment in the present disclosure to provide a ski equipment case that allows equipment to be placed directly into the interior cavity thereof, without requiring axial insertion therein. Accordingly, the upper and lower halves of the outer box and inner box open like a briefcase, to allow the skis to be directly inserted and secured in the interior cavity.

The present disclosure describes a ski equipment case suitable for carrying lengthy ski equipment such as snow skis, a snowboard and ski poles. The case comprises a pair of an inner box and an outer box, each having an upper half and lower half that are connected by a hinge so that the two halves can move relative to each other between an open and closed position of the case. The inner box slides within the outer box between a compact position wherein the inner box is completely within the outer box and various elongated positions to allow for various sized ski equipment. The case also includes locking means to fix the inner box and outer box at various positions.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
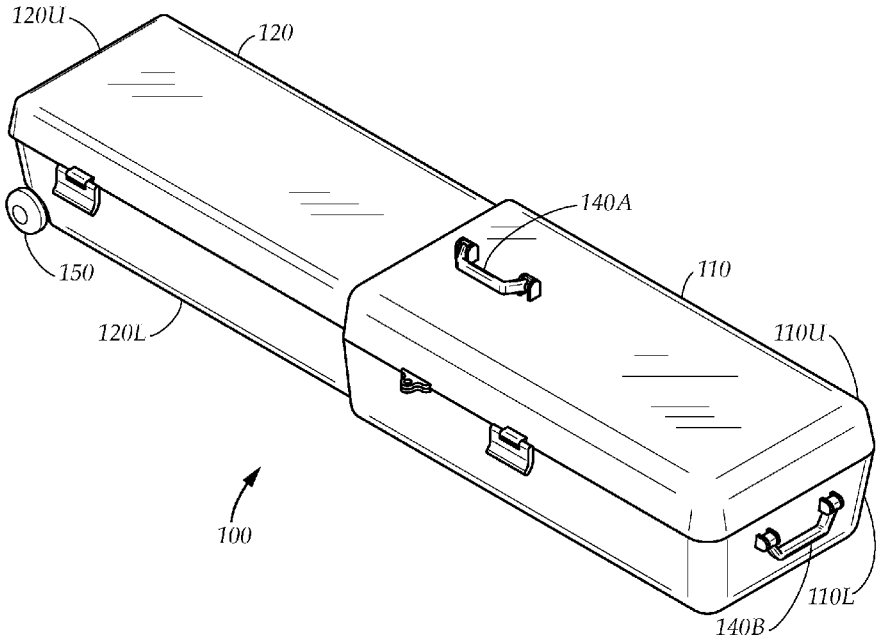
FIG. 1 is a diagrammatic perspective view illustrating an embodiment of a case suitable for carrying ski equipment, in a closed position.
Figure 2:
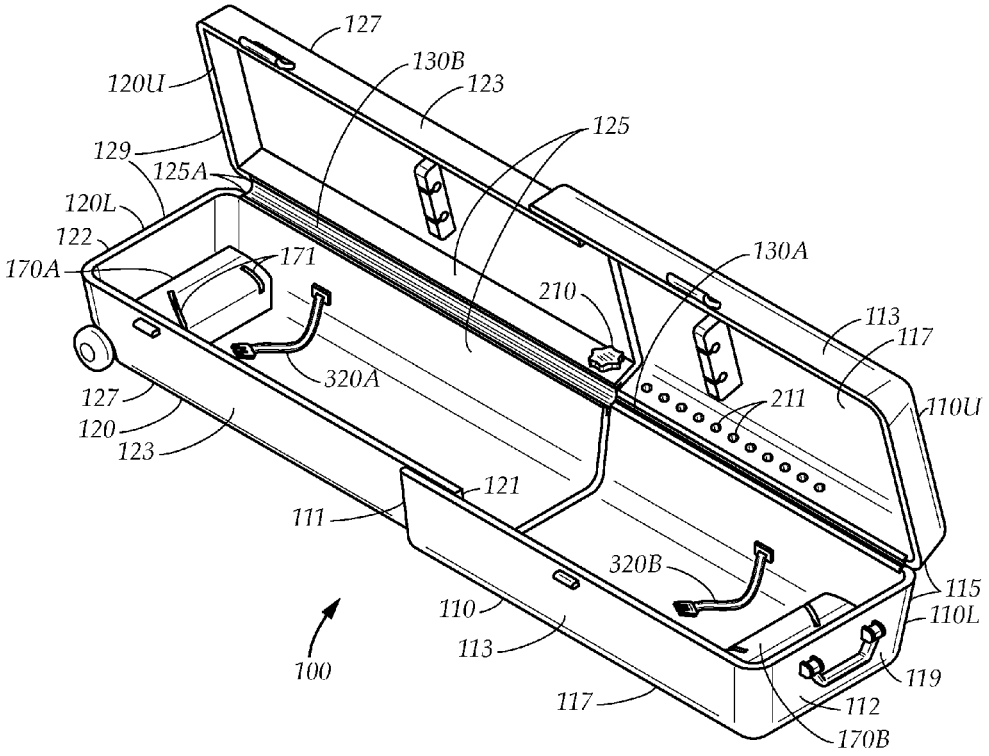
FIG. 2 is a diagrammatic perspective view illustrating an embodiment of the case suitable for carrying snow skis in a ski-storing position, the case in an opened position.

FIG. 1 and FIG. 2 illustrate a case 100 suitable for carrying skiing equipment. The case 100 has an inner box 120 and an outer box 110. The outer box 110 has an open end 111 and a closed end 112. The inner box 120 is similar in shape to the outer box 110 but has a slightly smaller cross sectional profile so that it can slide within outer box 110 completely thorough the open end 111 of outer box 110. Referring to FIG. 2, the inner box 120 also has an open end 121 and a closed end 122. The open end 121 of the inner box 120 extends into the outer box 110 from its open 111 so as to form a single interior cavity between the outer box 110 and inner box 120, fully between the closed ends 112, 122, suitable for accommodating elongated ski equipment therein.

Further, each of the boxes 110 and 120 is bisected by a horizontal plane into two halves. Outer box 110 has an upper half 110U and a lower half 110L. Similarly, inner box 120 has an upper half 120U and a lower half 120L.

Figure 3:
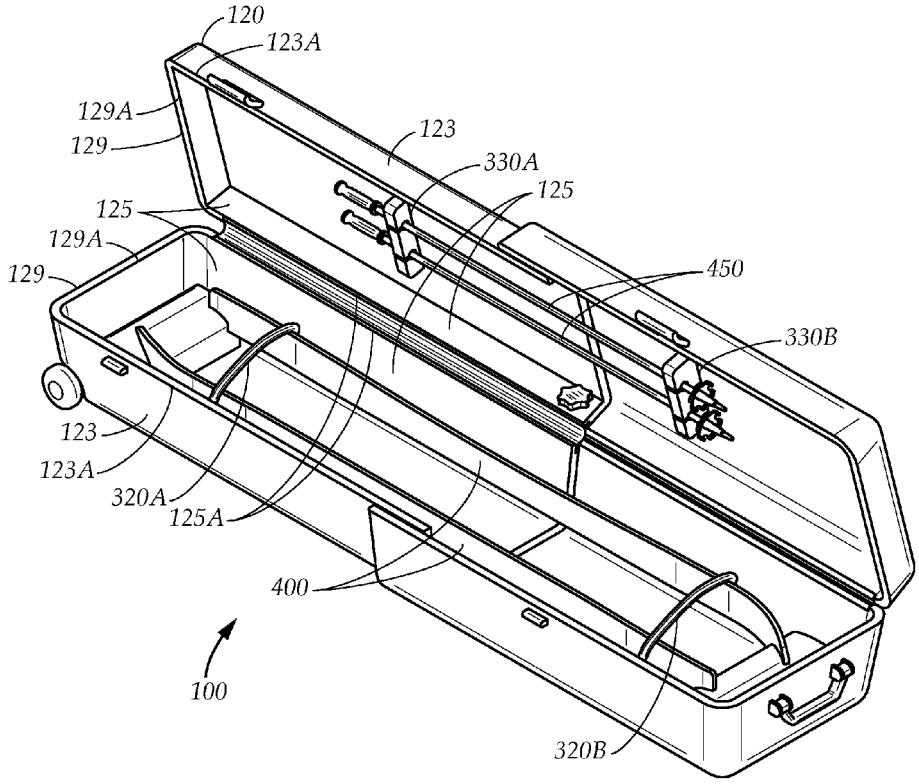
FIG. 3 is a diagrammatic perspective view illustrating an embodiment of the case suitable wherein a pair of skis and ski poles are secured therein.
Figure 4:
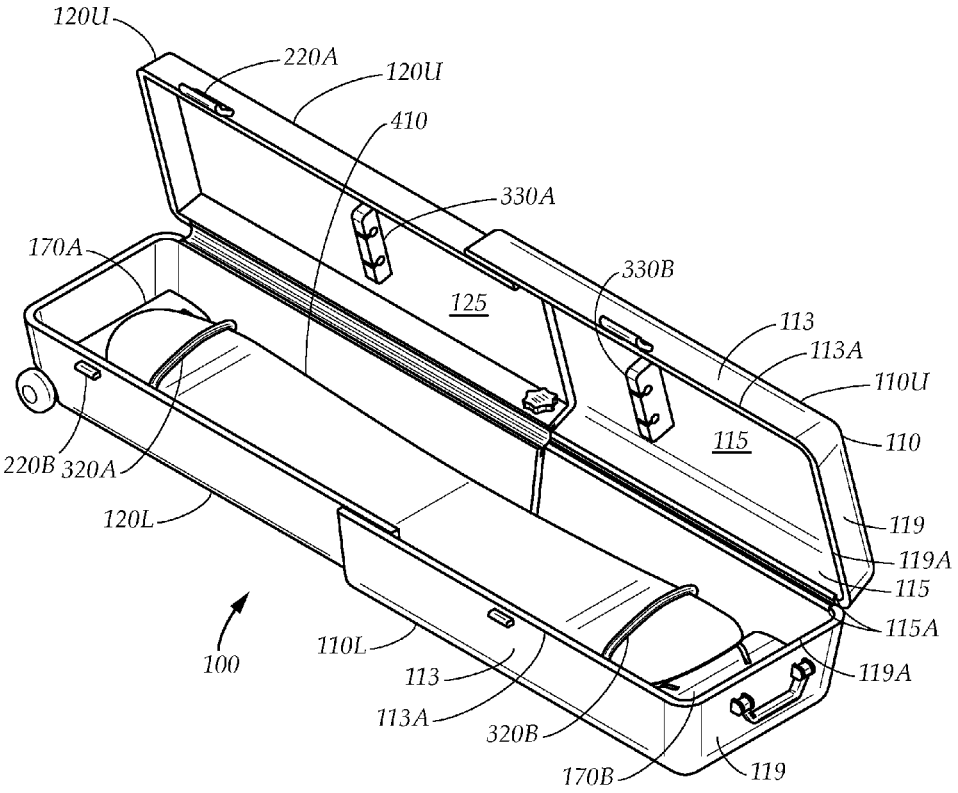
FIG. 4 is a diagrammatic perspective view illustrating an embodiment of a case wherein a snowboard is secured therein.

Each of the halves 110U and 110L of the outer box 110 have a front panel 113, a rear panel 115, a main panel 117, and an end panel 119, which together define an interior volume of said half 110U, 110L. Similarly, each half 120U, 120L of the inner box 120 has a front panel 123, a rear panel, 125, a main panel 127, and an end panel 129, which together define an interior volume of said half 120U, 120L. Note that the end panels 119, 129 are located at the closed ends 112, 122 of each respective half 110U, 110L, 120U, 120L of the outer box 110 and inner box 120. Referring momentarily to FIG. 3, each of panels 123, 125, and 129 of the inner box 120 has a free longitudinal edge 123A, 125A, and 129A. Referring momentarily to FIG. 4, each of the panels 113, 115, and 119 of the outer box 110 has a free longitudinal edge 113A, 115A, and 119A.

Figure 6:
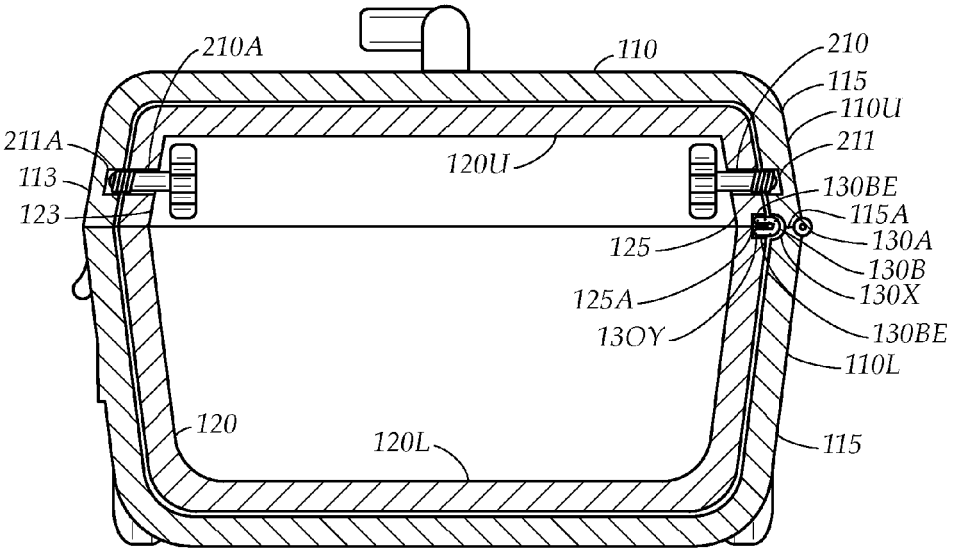
FIG. 6 is a side elevational view of the case, with parts broken away, illustrating the nesting of the outer box and inner box, and operation of a screw/knob for positionally fixing the inner box and outer box of the case.

The case 100 has hinges 130A and 130B. The upper half 110U, 120U of each of the boxes 110, 120 is hinged to the lower half 110L, 120L of the corresponding box at the free longitudinal edges 115A, 125A of each of the rear panels 115, 125 of the halves using hinge 130A and 130B, respectively. Note that the hinges 130A are preferably nested, extending parallel, on the same horizontal plane, and with their folding axis as close together as possible, to facilitate the outer box 110 and inner box 120 opening and closing together. Referring to FIG. 6, the free longitudinal edges 115A of the halves 110L, 110U of the outer box 110 preferably have a hinge slot 130X, for accommodating the hinge 130B of the inner box 120, allowing it to protrude outwardly into said hinge slot 130X when the case 100 is in the closed position shown. In addition, the free longitudinal edges 125A of the halves 120U, 120L preferably have a hinge recess 13OY, for facilitating attachment of the hinge 130B of the inner box 120. In particular, the hinge 130B of the inner box 120 is preferably an elongated, thin, flexible member that has two hinge ends 130BE that are each attached within the hinge recess 13OY of one of the free longitudinal edges 125A of one of the halves 120U, 120L. The hinge 130A of the outer box 110 is preferably external, connecting the rear panels 115 just outside of the outer box 110, as seen in FIG. 6.

The hinges 130A, 130B allow the case to open like a briefcase as seen in FIGS. 2, 3, and 4. In particular, the hinges 130A, 130B allow the case to pivot open, whereby full access is provided to the interior volume of the case 100, along the free longitudinal edges 113A, 115A, 119A of the outer box 110 and the free longitudinal edges 123A, 125A, 129A of the inner box 120.

Figure 5A:
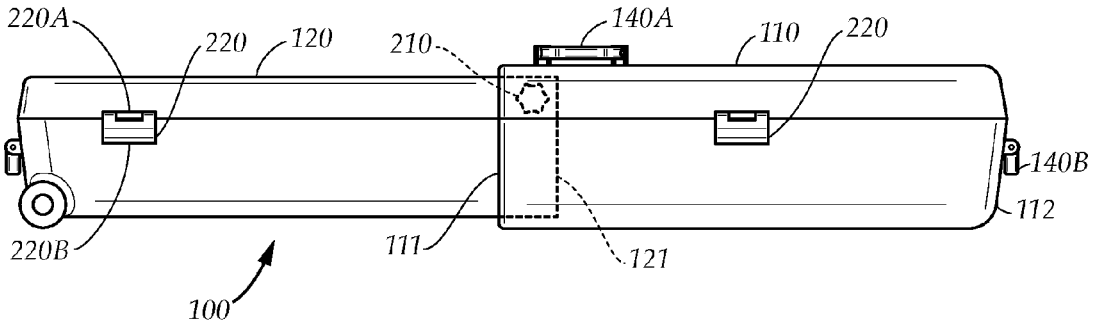
FIG. 5A is a diagrammatic back view illustrating an embodiment of a case suitable for carrying snow skis in a ski-storing position when closed.
Figure 5B:
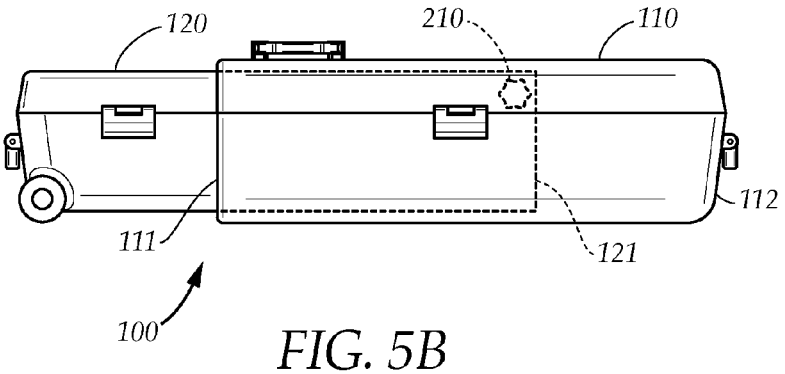
FIG. 5B is a diagrammatic back view illustrating an embodiment of the case in FIG. 5A, which has been adjusted to a reduced length for carrying shorter ski equipment.

Case 100 includes means for slidably engaging the outer and inner boxes so that the inner box 120 can slide outwardly of the outer box 110 between an initial compact position seen in FIG. 5B and a plurality of extended ski storing positions, including as seen in FIG. 5A. In general, the open end of the inner box 120 extends through the open end 121 of the inner box 120 and extends into the outer box 110 toward the fixed end of the outer box, thus moving the fixed end of the inner box toward the fixed end 112 of the outer box as the case 100 retracts toward the initial compact position. Various mechanisms may be provided to facilitate the slidable movement, and maintain structural integrity between the outer box 110 and inner box 120 including mating tracks, rails, and grooves between the outer box 110 and inner box 120. Since such arrangements for the sake of providing telescopic functionality are well known by those skilled in the art, detailing such mechanisms is beyond the scope of the present disclosure.

Case 100 includes means for locking the inner box 120 to the outer box 110 at various relative positions. Locking means may be a detent mechanism or a screw arrangement. As shown in FIG. 2, locking means is in the form of detent means such as a knob or screw 210. Locking screw 210 is provided near the open end portion of the upper half 120U of the inner box 120. The screw 210 may operate frictionally—tightening against the outer box 110, or aligned locking holes 211 may be provided on the corresponding portions of the outer box 110 at predetermined locations, as shown in FIG. 2. The predetermined locations for the aligned locking holes are chosen so that when the screw 210 locks the two boxes by engaging in the holes, the boxes are at the compact position or one of the predetermined ski storing positions. FIG. 6 shows an end sectional view of the case 100 illustrating the screw 210 extending through the rear wall 125 of the upper half 120U of the inner box 120, and the operation of the screw 210 and potential locking into the aligned locking holes 211 in the rear wall 115 of the upper half 120U of the outer box 110. The screw 210 is mounted on the inner box and engages with the outer box when screwed in after the inner box has been slid to a desired position within the outer box 110. In addition, a secondary screw 210A may be provided in the front wall 123 of the upper half 120U of the inner box 120 for additional stability. The aligned locking holes 211A may be provided in the front wall 113 of the upper half 110U of the outer box 110.

It may be apparent that when the engaging means is in the form of a track slide arrangement, the locking means may be provided in the form of a detent means on the track slide arrangement to enable the locking of the rail to the grove at the various predetermined positions of the case 100.

FIGS. 2-4 illustrate the case 100 having adaptations for storing different types of ski equipment. In particular, the case 100 has ski brackets 170A, 170B and ski straps 320A, 320B, secured to the lower halves 110L, 120L for accommodating and securing to ski equipment. In particular, the ski brackets are each secured to the main panel 117, 127 of the lower halves 110L, 120L, near their end panels 119, and 129. The ski brackets 170A, 170B may include ski bracket slots 171 for directly accommodating skis and their expected contours.

The case 100 also includes means for retaining the skis in the case 100, which may include the straps 320A, and 320B. As shown in FIG. 3, skis 400 may be laid on their sides with opposite ski tips facing each other and straps 320A and 320B may be used to secure each ski to the sides of the case 100 either at the middle of skis and/or at each end of the skis to keep them in place while the case is being carried. The case 100 also includes a soft material provided on at least some portion of the inner surface. Preferably, hard foam of substantial thickness is provided on the inner surface of the case at the closed ends of the two boxes to provide cushioning to the delicate parts of the ski such as tips and tails. It may be apparent that although the invention has been described with specific reference to snow skis, the case described herein may be used for other skiing equipment such as a snowboard 410 as illustrated in FIG. 4, wherein the brackets 170A, 170B are not used for securing the snowboard 410, but the straps 320A, 320B provide the primary means for securing the snowboard 410. The case also includes means for securing ski poles and other accessories. In particular, the case has pole brackets 330A, 330B mounted to the main panel 115, 125 of the upper halves 110U, 120U of the outer box 110 and inner box 120. As illustrated in FIG. 3, ski poles 450 are secured within the pole brackets 330A, 330B.

The case 100 also includes means for securely holding the upper halves 110U, 120U to the lower halves 110L, 120L in the closed position. As shown in FIGS. 4 and 5A both the inner and outer boxes may be provided with a latching mechanisms 220, each comprising an upper latching mechanism component 220A attached to the upper halve 110U, 120U, and a lower latching component 220B attached to the lower halve 110L, 120L, so that the case 100 can be securely locked in the closed position.

The case 100 also includes means for holding and carrying the case. Ergonomic handles may be provided on the outer surface of the case such as handles 140A and 140B shown in FIG. 1 and FIG. 5A.

The case 100 also includes means for moving the case 100 along the ground. As shown in FIG. 1, one end of the case 100 has wheels 150 for moving the case along the ground while holding the case 100 using the handle 140B from the other end.

FIG. 5A shows the case 100 fully extended to maximum length in a closed position. The locking screw 210 may be operated to unlock the inner and outer boxes and the inner box may be slid in to the outer box as shown in FIG. 5B. Once, the desired length is achieved, the locking screw 210 may be locked again.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a case for carrying sports equipments such as snow skis, boards and the like which is adjustable to various sizes, is strong sturdy and collapsible. The disclosure is illustrated by example in the drawing figures, and throughout the written description. It should be understood that numerous variations are possible, while adhering to the inventive concept. Such variations are contemplated as being a part of the present disclosure.

What is claimed is:

1. A ski equipment case, for storing and transporting ski equipment, comprising:

an outer box having an upper half and a lower half, each of the upper half and lower half of the outer box including a main panel, a front panel, a rear panel, an end panel, and an open end opposite from the end panel;

an inner box having an upper half and a lower half, each of the upper half and lower half of the inner box including a main panel, a front panel, a rear panel, an end panel, and an open end opposite from the end panel;

wherein the upper half and lower half of the outer box are connected to each other by a hinge and the rear panels thereof, and the upper half and lower half of the inner box are connected to each other by a hinge at the rear panels thereof;

wherein the open end of the inner box extends inside of the outer box, whereby the inner box is slidably mounted to extend partially within the outer box and to selectively move the end panels of the outer box and inner box toward and away from each other;

wherein the outer box and inner box together define an interior cavity which is adjustable in length by slidable adjustment of the inner box with respect to the outer box, the interior cavity including a first ski securing strap mounted to the lower half of the inner box and a second ski securing strap mounted to the lower half of the outer box;

wherein the hinge of the outer box is parallel with and immediately adjacent to the hinge of the inner box, such that the upper halves of the inner box and outer box pivot in unison with respect to the lower halves of the inner box and outer box by the respective hinges of the inner box and outer box to bring the ski equipment case from a closed position to an open position; and wherein the rear panels of each of the upper and lower halves of the inner box and outer box have a free longitudinal edge; wherein the hinge of the outer box connects the free longitudinal edges of the rear panels of the upper and lower halves of the outer box; wherein the hinge of the inner box connects the free longitudinal edges of the rear panels of the upper and lower halves of the inner box; and wherein the hinge of the inner box is coplanar with the hinge of the outer box, and the hinge of the inner box is nested with the hinge of the outer box.

2. The ski equipment case as recited in claim 1, wherein the hinge of the outer box extends outside of the outer box, wherein the outer box has a hinge slot in the free longitudinal edges of the upper and lower halves of the outer box for allowing the hinge of the inner box to protrude into the hinge slot when the ski equipment case is in the closed position.

3. The ski equipment case as recited in claim 2, further comprising at least one locking screw, extending transversely through the rear wall of the upper half of the inner box to selectively meet the rear wall of the upper half of the outer box to positionally fix the outer box with respect to the inner box.

4. The ski equipment case as recited in claim 3, wherein the rear wall of the upper half of the outer box has adjustment holes for selectively allowing the locking screw to extend therein to positionally fix the outer box with respect to the inner box.

5. The ski equipment case as recited in claim 4, wherein the front panels and end panels have free longitudinal edges, and wherein when the ski equipment case is in the closed position the free longitudinal edges of the front panels and end panels of the upper halves of the inner box and outer box rest upon the free longitudinal edges of the front panels and end panels of the lower halves of the inner box and outer box.

6. The ski equipment case as recited in claim 5, wherein the hinge of the inner box is a thin flexible member having a first hinge end and a second hinge end, the first hinge end is attached to the free longitudinal edge of the rear panel of the upper half of the inner box and the second hinge end is attached to the free longitudinal edge of the rear panel of the lower half of the inner box, wherein the hinge of the inner box extends along substantially the entire length of the free longitudinal edges of the rear panels of the upper and lower halves of the inner box, and wherein the hinge of the inner box folds and protrudes into the hinge slot of the outer box when the ski equipment case is in the closed position.

7. A ski equipment case, for storing and transporting ski equipment, comprising:

an outer box having an upper half and a lower half, each of the upper half and lower half of the outer box including a main panel, a front panel, a rear panel, an end panel, and an open end opposite from the end panel;

an inner box having an upper half and a lower half, each of the upper half and lower half of the inner box including a main panel, a front panel, a rear panel, an end panel, and an open end opposite from the end panel;

wherein the upper half and lower half of the outer box are connected to each other by a hinge and the rear panels thereof, and the upper half and lower half of the inner box are connected to each other by a hinge at the rear panels thereof;

wherein the open end of the inner box extends inside of the outer box, whereby the inner box is slidably mounted to extend partially within the outer box and to selectively move the end panels of the outer box and inner box toward and away from each other;

wherein the outer box and inner box together define an interior cavity which is adjustable in length by slidable adjustment of the inner box with respect to the outer box, the interior cavity including a first ski bracket and a second ski bracket the first ski bracket is mounted to the main panel of the outer box near the end panel of the outer box and the second ski bracket is mounted to the main panel of the inner box near the end panel of the inner box, the interior cavity also have pole brackets mounted to the main panels of the upper halves of the inner box and outer box;

wherein the hinge of the outer box is parallel with and immediately adjacent to the hinge of the inner box, such that the upper halves of the inner box and outer box pivot in unison with respect to the lower halves of the inner box and outer box by the respective hinges of the inner box and outer box to bring the ski equipment case from a closed position to an open position; and wherein the rear panels of each of the upper and lower halves of the inner box and outer box have a free longitudinal edge; wherein the hinge of the outer box connects the free longitudinal edges of the rear panels of the upper and lower halves of the outer box; wherein the hinge of the inner box connects the free longitudinal edges of the rear panels of the upper and lower halves of the inner box, and wherein the hinge of the inner box is coplanar with the hinge of the outer box, and the hinge of the inner box is nested with the hinge of the outer box.

8. The ski equipment case as recited in claim 7, wherein the hinge of the outer box extends outside of the outer box, wherein the outer box has a hinge slot in the free longitudinal edges of the upper and lower halves of the outer box for allowing the hinge of the inner box to protrude into the hinge slot when the ski equipment case is in the closed position.

9. The ski equipment case as recited in claim 8, further comprising at least one locking screw, extending transversely through the rear wall of the upper half of the inner box to selectively meet the rear wall of the upper half of the outer box to positionally fix the outer box with respect to the inner box.

10. The ski equipment case as recited in claim 9, wherein the rear wall of the upper half of the outer box has adjustment holes for selectively allowing the locking screw to extend therein to positionally fix the outer box with respect to the inner box.

11. The ski equipment case as recited in claim 10, wherein the front panels and end panels have free longitudinal edges, and wherein when the ski equipment case is in the closed position the free longitudinal edges of the front panels and end panels of the upper halves of the inner box and outer box rest upon the free longitudinal edges of the front panels and end panels of the lower halves of the inner box and outer box.

12. The ski equipment case as recited in claim 11, further comprising a latching mechanism releasably holding the upper halves of the outer box and inner box to the lower halves of the outer box and inner box, the latching mechanism includes an upper latching mechanism component attached to each of the front panels of the upper halves, and a lower latching mechanism component attached to each of the front panels of the lower halves.

13. The ski equipment case as recited in claim 12, further comprising a secondary screw, wherein the front wall of the outer box has adjustment holes, wherein the adjustment screw extends through the front wall of the inner box for selectively extending into one of the adjustment holes in the front wall of the outer box for positionally fixing the outer box with respect to the inner box.

14. The ski equipment case as recited in claim 13, wherein the hinge of the inner box is a thin flexible member having a first hinge end and a second hinge end, the first hinge end is attached to the free longitudinal edge of the rear panel of the upper half of the inner box and the second hinge end is attached to the free longitudinal edge of the rear panel of the lower half of the inner box, wherein the hinge of the inner box extends along substantially the entire length of the free longitudinal edges of the rear panels of the upper and lower halves of the inner box, and wherein the hinge of the inner box folds and protrudes into the hinge slot of the outer box when the ski equipment case is in the closed position.

* * * * *